US007493919B2

(12) United States Patent
Volpi et al.

(10) Patent No.: US 7,493,919 B2
(45) Date of Patent: Feb. 24, 2009

(54) WEAVING LOOM WITH MOTOR-DRIVEN FRAMES

(75) Inventors: Corrado Volpi, Treviolo (IT); Angelo Gallizioli, Leffe (IT)

(73) Assignee: Promatech S.p.A., Colzate (Bergamo) (IT)

( * ) Notice: Subject to any disclaimer, the term of this patent is extended or adjusted under 35 U.S.C. 154(b) by 441 days.

(21) Appl. No.: 11/068,802

(22) Filed: Mar. 2, 2005

(65) Prior Publication Data

US 2005/0194055 A1 Sep. 8, 2005

(30) Foreign Application Priority Data

Mar. 2, 2004 (EP) ..... 04425134

(51) Int. Cl.
*D03C 13/00* (2006.01)

(52) U.S. Cl. ..... 139/55.1

(58) Field of Classification Search ..... 139/55.1, 139/11, 66 R–81, 455
See application file for complete search history.

(56) References Cited

U.S. PATENT DOCUMENTS 6,573,623 B2 * 6/2003 Tsuboi et al. ..... 310/12
2001/0054851 A1 * 12/2001 Tsuboi et al. ..... 310/12
2002/0089237 A1 * 7/2002 Hazelton ..... 310/12
2005/0145288 A1 * 7/2005 Liue ..... 139/11
2007/0137719 A1 * 6/2007 Pohl ..... 139/55.1

FOREIGN PATENT DOCUMENTS

| | | |
|---|---|---|
| CH | 255 378 | 6/1948 |
| DE | 198 21 094 | 7/1999 |
| EP | 0 879 908 | 11/1998 |
| EP | 1 215 318 | 6/2002 |
| EP | 1 239 068 | 9/2002 |

* cited by examiner

*Primary Examiner*—Gary L Welch
*Assistant Examiner*—Andrew W Sutton
(74) *Attorney, Agent, or Firm*—Young & Thompson

(57) ABSTRACT

A control mechanism of a heald frame in weaving looms is disclosed, of the type comprising a frame hinged to an articulated linkage capable of converting the substantially rectilinear motion of a control bar into a vertical motion of the frame, characterised in that said bar is provided with a permanent magnet body and in that an electric-coil structure is further provided, in whose proximity said magnet body is intended to slide, fixed in respect of the loom and forming the armature of a linear electric motor of which the magnet body represents the mobile part. Some preferred arrangements of a plurality of such mechanisms in a weaving loom are further disclosed.

15 Claims, 6 Drawing Sheets

WEAVING LOOM WITH MOTOR-DRIVEN FRAMES

TECHNICAL FIELD

1. Field of the Invention

The present invention relates to a weaving loom with motor-driven frames.

2. Prior Art

As is known, a weaving loom comprises several weaving members, including a plurality of healds, within which are guided the warp yarns, which are lifted and lowered by an array of ropes individually controlled by a suitable (Jacquard) machine or by a series of frames, to which they are fixed, which perform an alternate vertical movement. In the following part of the description, reference will be made exclusively to this second loom design, wherein a plurality of heald frames, packed mutually adjacent, reciprocates with an alternate motion within the loom shoulders.

Frame motion is traditionally accomplished by means of a dobby, that is, a leverage system acting below each frame lifting and lowering it with an alternate motion.

The dobby is a programmable device of a substantially mechanical nature, which receives a rotary motion from motor means (the same main motor of the loom or a specific separate electric motor) and delivers it to the various frames in a differentiated and coordinated manner.

Although technological progress has introduced many improvements, the dobby is by nature a rather complex and substantially not very flexible device which requires anyhow a significant intervention to be reprogrammed whenever a different item needs to be woven.

Attempts have hence been made in the textile industry to increase the flexibility of the frame controls, both directed at implementing a complex motion law, and at easily adapting the motion law of the individual frames to current requirements, in a cost-effective way and without hardhitting interventions or prolonged down times.

A first step consisted in releasing the frames from each other and in controlling them individually by single motors. Such a solution is disclosed, for example, in EP 1.215.317. However, despite the control flexibility which can thus be achieved, the costs and especially the loom side dimensions are noticeably increased. Furthermore, the displacement of each frame is all the same constrained by the kinematic chain transforming the full rotation of the motor into linear motion: it is therefore not possible to vary the frame displacement acting on the electronic control of the motors.

Other proposed solutions provide to do completely without the frame leverages and to arrange instead a pair of linear motors to act directly on two connection points of the individual frame: examples of this technology are disclosed in EP 1.215.318, EP 1.239.068 and JP11350285. These proposals, however, which are more theoretical rather than actually implementable, give rise to two kinds of issues.

On the one hand, the use of at least two motors for each frame raises an issue with control coordination and synchronism, which can be partially solved by electronic means, but always carries safety-related disadvantages in case of electronic system failure. On the other hand, whenever the linear motor is subject to dimensional constraints, power and overheating problems arise. Finally, some residual problems due to the loom side dimensions remain.

It is hence an object of the present invention to provide an arrangement for control heald frames which overcomes all the disadvantages heretofore described. Specifically, it is sought to provide a control arrangement mechanism for heald frames which may be programmed, both in terms of displacement and motion law, and in terms of its variation over time, in an extremely flexible and expedite manner; at the same time, the control arrangement should not occupy side space behind the loom shoulders; also, it should allow to deliver a suitable amount of power in a sufficiently effective manner onto the frames, so as to also limit overheating problems. Finally, there should preferably be one motor drive for each frame, in order to avoid problems arising from the synchronisation of two or more motors and from the handling of electronic faults.

BRIEF DESCRIPTION OF THE INVENTION

Such objects are achieved by a control mechanism and by an arrangement of a plurality of such mechanisms as described in their essential features in the attached main claims.

Other inventive aspects of the invention are described in the dependent claims.

In particular, according to a first aspect of the invention, each frame is driven by a motor consisting of a series of electric coils, fixed to the loom, which make up the motor stator, and of a permanent magnet shifting integrally with a bar of the articulated quadrilateral kinematic mechanism which guides the frame and makes up the rotor of the electric motor.

According to another aspect, the overall control of the frames is accomplished by means of an arrangement comprising a plurality of such motors, arranged along the loom width in an offset manner, for example on four modules, which is repeated in parallel along the loom depth.

According to a further aspect, the coils and the permanent magnets are advantageously offset both above and below the bar of the kinematic mechanism.

Finally, according to another aspect, a power recovery system using capacitors is provided to minimise the demand for the power absorbed by all the linear motors.

BRIEF DESCRIPTION OF THE DRAWINGS

Further features and advantages of the mechanism and of the arrangement according to the invention will in any case be clearer from the following detailed description of some preferred embodiments thereof, given by way of example and illustrated in the accompanying drawings, wherein.

PREFERRED EMBODIMENTS OF THE INVENTION

Figure 1:
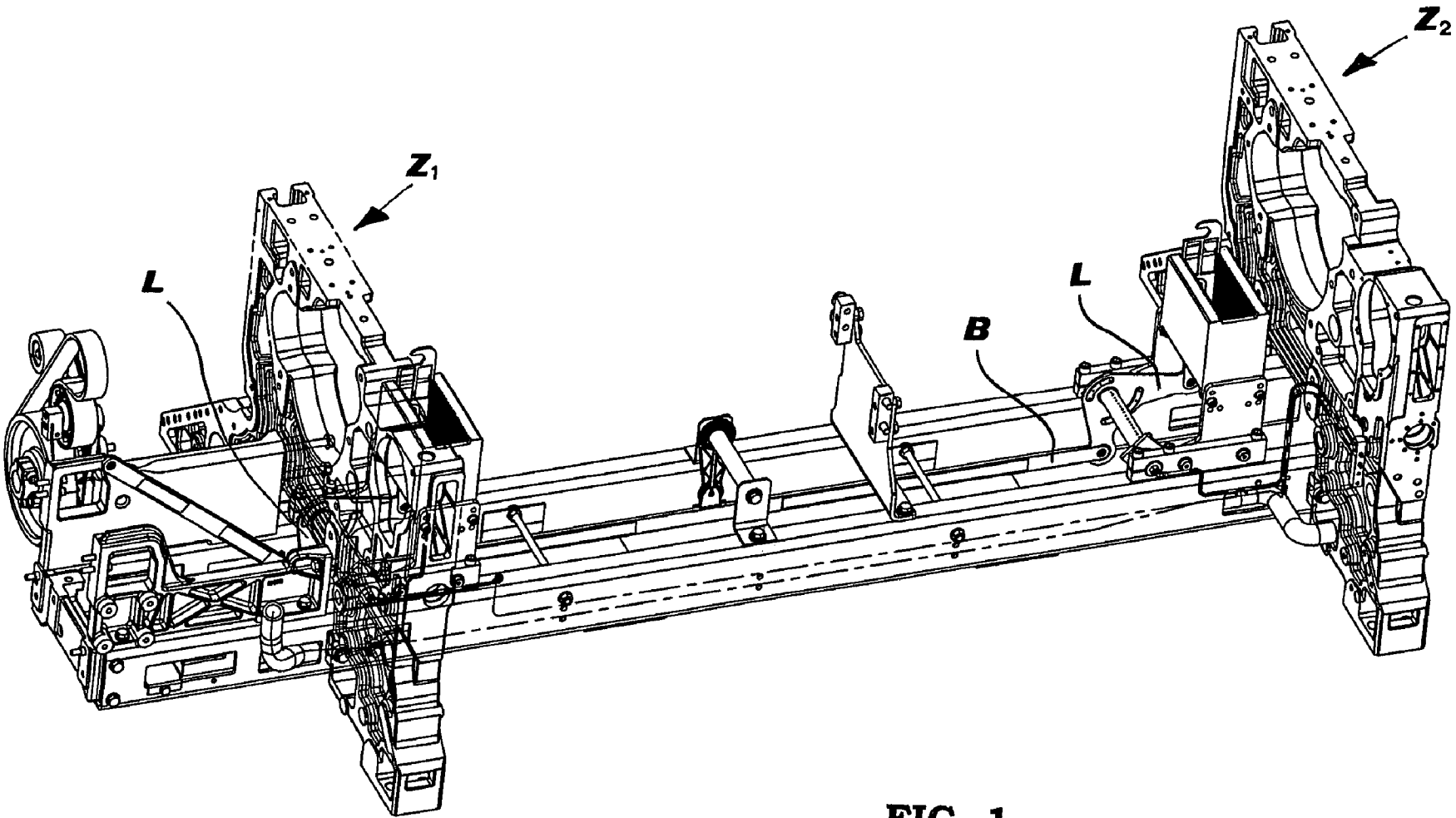
FIG. 1 is a perspective view of the dobby mechanism of an exemplary weaving loom.

In FIG. 1 there is illustrated an exemplary arrangement of a dobby according to the prior art. As it can be seen, the driving mechanism of the heald frames (not shown) is located between the two loom shoulders $Z_1$ and $Z_2$ and consists of two right-angled levers L (only the right one clearly visible) mutually linked to a bar B. On one side of the loom, for example beyond the left loom shoulder $Z_1$, the control and drive unit (partly shown) of the dobby is housed.

Figure 2:
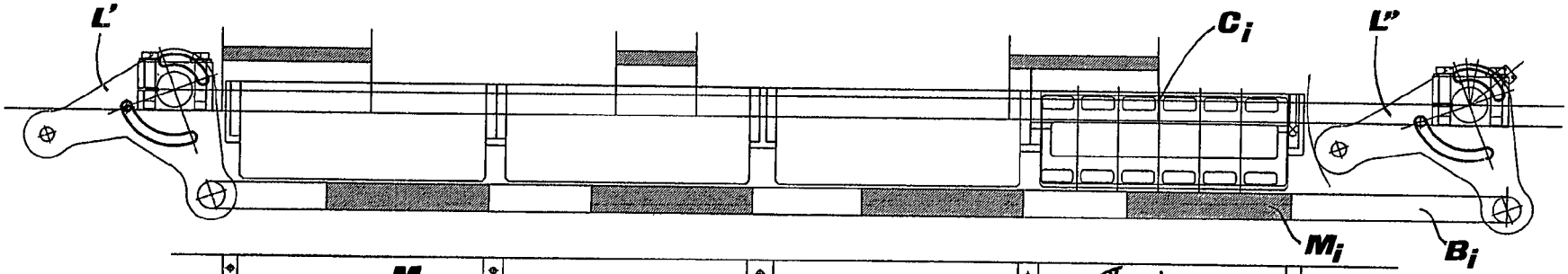
FIG. 2 is an elevation front view corresponding to FIG. 1, wherein only the driving portion of the kinematic mechanism is represented.
Figure 3:
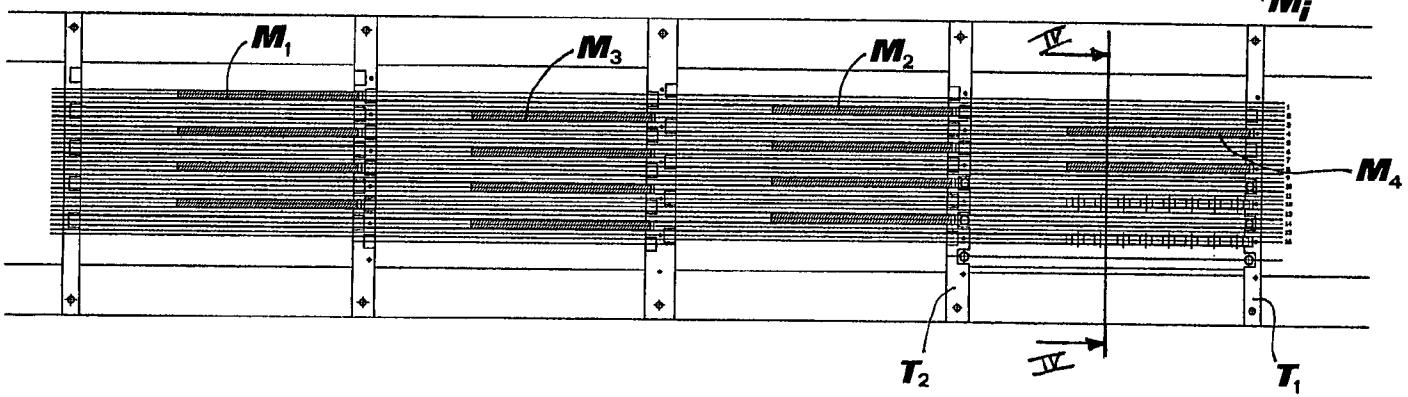
FIG. 3 is a top plan view corresponding to FIG. 2, wherein a plurality of motors are diagrammatically illustrated.

As can be seen in FIGS. 2 and 3, the motor-driven control of the invention is instead accomplished through linear motors modularly arranged in the bottom part of the frames, between the loom shoulders.

In particular, each frame $Q_i$ (where i indicates the $i^{th}$ frame) is restrained, in a manner known per se, by two oscillating end levers $L_i'$ and $L_i''$, in turn hinged to a same horizontal connection bar $B_i$, according to an articulated quadrilateral linkage design with identical opposed sides. The reciprocating horizontal movement of each bar B translates—by means of the pair of levers—into a vertical alternate translation of the corresponding frame Q; the complete displacement of the frames, even of those in a most backward position which are to open the warp shed most widely, is accomplished through lever rotations normally smaller than ±45°. In actual fact, the movement of bar B, since said bar is directly hinged to the bottom ends of the pair of levers (see FIG. 2), during the vertical translation of the frames consists of a shifting of its centre of gravity along an arch of a circle, i.e. with a horizontal and a vertical component. This circumstance will be addressed again later in the text with further observations on the arrangement of the invention.

According to the invention, to each bottom connection bar $B_i$ is attached a permanent magnet body $M_i$. The permanent magnet $M_i$ is plate-shaped and provided with a series of individual dual polarity magnets $m_{n,i}$ (where n indicates the $n^{th}$ individual magnet of the $i^{th}$ magnet $M_i$), arranged serially along the longitudinal motion axis of the magnet body M to obtain the result which will be illustrated in greater detail further on.

Figure 4:
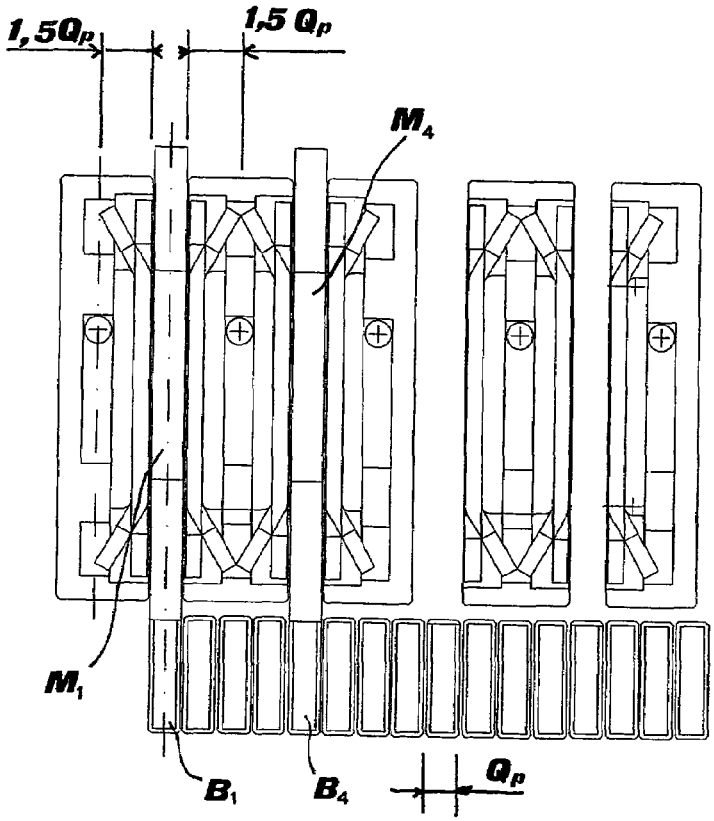
FIG. 4 is a section view taken along the line IV-IV of FIG. 3.
Figure 5:
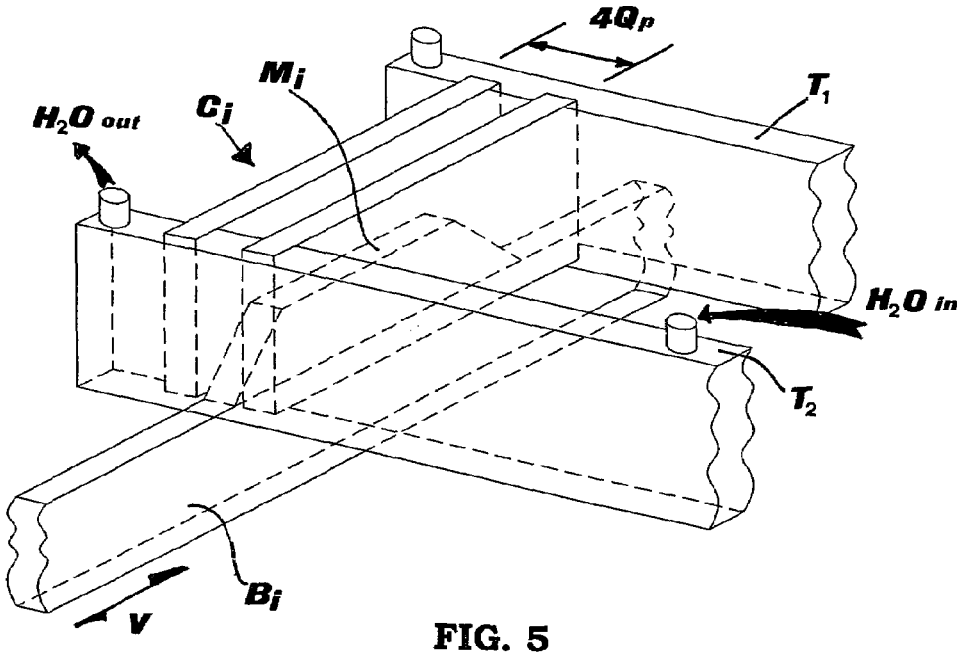
FIG. 5 is a partial see-through prospective view, which illustrates a detail of a magnet body between two coils.

In the embodiment illustrated in FIGS. 4 and 5, the magnet body M is fixed to the top edge of bar B and is entirely arranged in the upper part thereof.

Correspondingly, it is further provided a support structure onto which are mounted a series of electric coils or coil packs $C_i$ which make up the armature of the linear motors.

Each coil pack $C_i$ is made up of a series of discrete turns, mutually packed in the longitudinal movement direction of bar $B_i$. Each pack of coils $C_i$ preferably consists of three or four (FIG. 7) basic coils, which can be controlled and powered individually.

The overall length of the adjacent packs of turns $C_i$, in the embodiment illustrated in FIG. 2, is greater than the length of the magnet body $M_i$: the length difference is at least equivalent to the maximum desired stroke of bar $B_i$ and consequently of the corresponding frame $Q_i$ (except for the transmission ratios).

The turns are progressively energised by an activation current, under the control of a specific electronic unit (not shown), so as to create a so-called "relay effect" on the whole magnet body $M_i$; in other words, a translating magnetic field is generated which continuously applies a pulling force on at least part of the magnets $m_{n,i}$: this guarantees a high and regular power transfer from the electric turns to the bar $B_i$ of the frames.

To detect moment by moment the position of the motor/magnet body M and to consequently pilot the turn activation current, a linear encoder mounted onto one of the right-angled levers L' or L" is for example provided.

The overall length of each motor (made up of the magnet body M and of the corresponding group of turns C) is advantageously a submultiple of the useful length of bar B: on a 1900 mm span, for example, four linear motors are provided. In this way it is possible to longitudinally offset the motors of the adjacent bars, according to an embodiment which optimises available spaces. In FIGS. 2 and 3, for example, is illustrated an arrangement of motors $M_i$ in groups of four motors each, each in a mutually offset position: therefore the arrangement of the first four frames is repeated for the frames $5^{th}$ to $8^{th}$ and so forth. In the final analysis this allows to have a larger transversal space available for housing the turns of the electric coil, to the benefit of the sizing and energy efficiency of the motors.

In FIGS. 4 and 5 there is illustrated an embodiment of the group of coils, arranged on the two sides of each magnet body of the motor. Since, according to the embodiment illustrated above, the motors are repeated at a corresponding lateral position (i.e. lying side by side at the same width of the loom) every four frames, each side of the coils has a depth space of 1.5 Qp available, where Qp is the thickness of a frame (equal to about 12 mm according to the current standard).

In FIG. 5, in particular, arrow V indicates the reciprocating translation direction of bar $B_i$ with the corresponding magnet body $M_i$. It should be noted that the support structure of the motor modules, represented by the beams $T_1$ and $T_2$, is preferably arranged so as to facilitate the thermal cooling of the system: for example the support beams are hollow and within them flows a cooling liquid, as indicated by arrows $H_2O$-in and $H_2O$-out.

Despite a liquid cooling system being expected, the arrangement and efficiency of the system according to the invention also allow to provide a simple air cooling system.

Finally, to minimise power demand, a power recovery system is preferably provided. The system provides for example the use of capacitors with suitable capacitive values, capable of storing energy during the motor regenerative step and of releasing it during a successive step: this also avoids energy dissipation over possible dissipation resistances.

The overall capacitance value is advantageously optimised thanks to the use of a power feeder section which is the same for all converters of the various motors (including the loom motor), as illustrated in the European patent application no. 03104560,2 in the name of the same Applicant.

Finally, to address the problem of the possible occurrence of a sudden mains power drop, an electro-magnetic brake (not shown) is provided, which goes into action mechanically (for example through spring elements) when the voltage drops.

Figure 6:
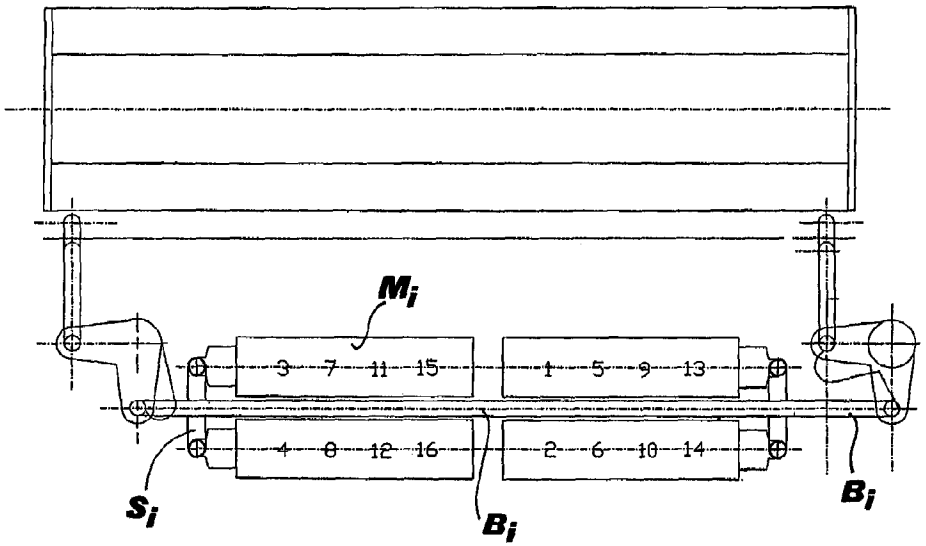
FIG. 6 is a diagrammatic view which illustrates the arrangement of the invention according to a preferred embodiment.
Figure 7:
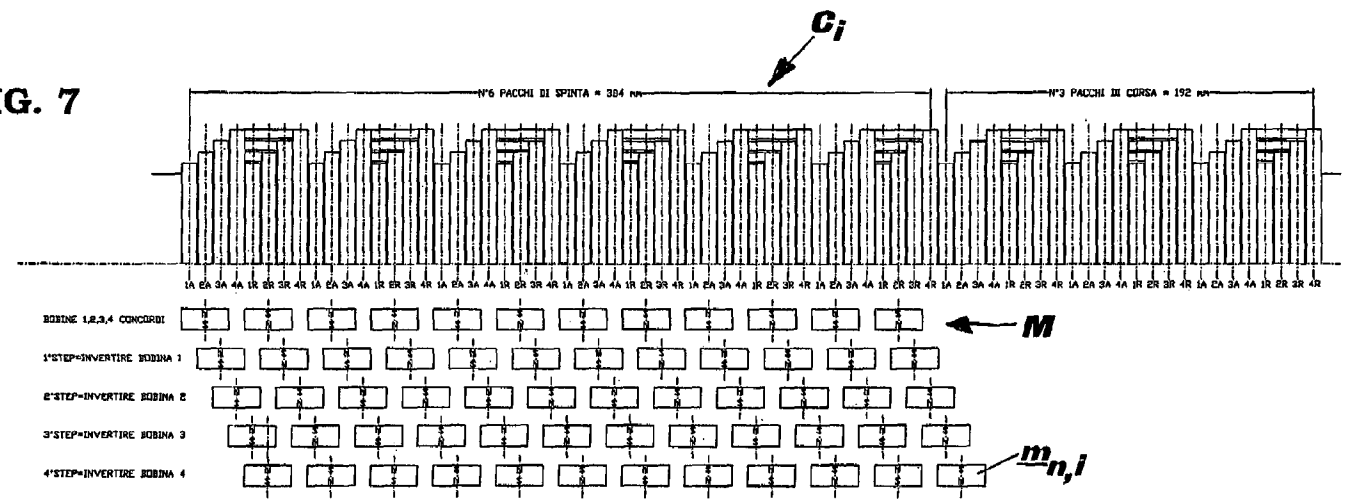
FIG. 7 is a diagram showing the arrangement design of the coils and of the permanent magnets according to a preferred embodiment of the invention.
Figure 8:
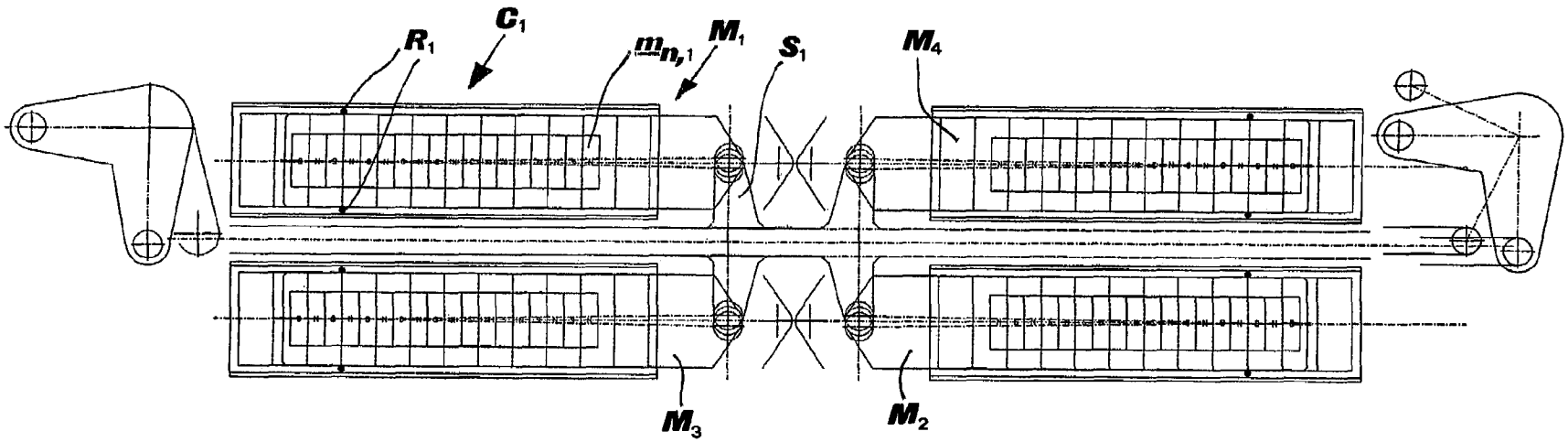
FIG. 8 is a diagrammatic view illustrating in greater detail the preferred embodiment of the invention in FIG. 7.

In FIGS. 6-8 a further preferred embodiment of the invention is illustrated.

In this case the electric turns are arranged partly above and partly below the bars B of the kinematic guide mechanism of the frames. By so doing, the side interference of the motors with one another is further reduced and it is therefore possible to build them longer, the transversal dimensions of the coils $C_i$ being equal. In particular, their width being equal, each motor can take up an extension substantially twice the one of the embodiment described previously.

As can be seen, each magnet body M can comprise up to 12 single magnets m and each motor armature comprises up to 9 packs of turns.

In FIG. 6 the arrangement found on the first four bars B is diagrammatically illustrated, which arrangement is repeated also behind (hence not visible in the figure) for the successive bars in groups of four, up to a pack of frames, for example, of sixteen.

In FIG. 7 the wiring diagram of a group of turns $C_i$ is illustrated, next to a series of magnets $m_{n,i}$ belonging to the same permanent magnet $M_i$, shown at five successive time instants (one below the other in the figure): as it can be seen, as the motor $M_i$ moves rightwards, in order to maintain an effective magnetic force coil polarity is progressively changed.

Ideally, with the above described arrangement, the group of turns can be divided into six thrust packs plus three stroke packs.

This arrangement allows to have a greater number of fixed magnets which work effectively in the translating magnetic field of the turns, so that it is possible to maintain lower voltage levels, with all the advantages this brings in terms of efficiency and heat dissipation.

Moreover, if the weaving loom is to work using a reduced number of frames (for example 12 instead of 16), the maximum required stroke is generally reduced (the warp shed is shorter and the maximum opening is therefore also smaller) and it is hence possible to have a larger number of magnets m working—the length of the body C of the coils being equal—, with a consequent further efficiency improvement. It is therefrom derived that the arrangement according to the invention is advantageously affected by the actual required performances, achieving real modularity also in terms of costs and power consumption.

From a manufacturing point of view, according to the preferred embodiment of the invention, each fixed magnet $M_i$ is mounted oscillating at one end of a bracket $S_i$ integral with each bar $B_i$: in FIG. 6 the brackets are provided at the outer ends of the magnets M, whereas in FIG. 8 said brackets are provided at the inner ends.

Each group of coils is also arranged in shape of a drawer, within which can slide the plate of the magnet body $M_i$. In such case, to second the vertical component of the displacement of bars $B_i$—which was mentioned earlier—the plate of magnet $M_i$ is free to rotate about the end hinged on the bracket $S_i$ and is slidingly guided into the drawer of coils $C_i$ by means of suitable sliding means $R_i$.

Such sliding means $R_i$ can be any member of a type known per se, which can be effortlessly identified by a skilled person in the field, which allows to guide the motor plate $M_i$, during a longitudinal translation movement, into the drawer of coils $C_i$ and, at the same time, allows the rotation thereof determined by the lifting and lowering of the end hinged to the bracket $S_i$.

Although the vertical component of the displacement of each bar B can be negligible in most cases, this last specific illustrated embodiment allows to greatly reduce the relative vertical shift between the magnets $m_{n,i}$ and the coils $C_i$, always maintaining maximum working efficiency in the magnetic field.

Figure 9A:
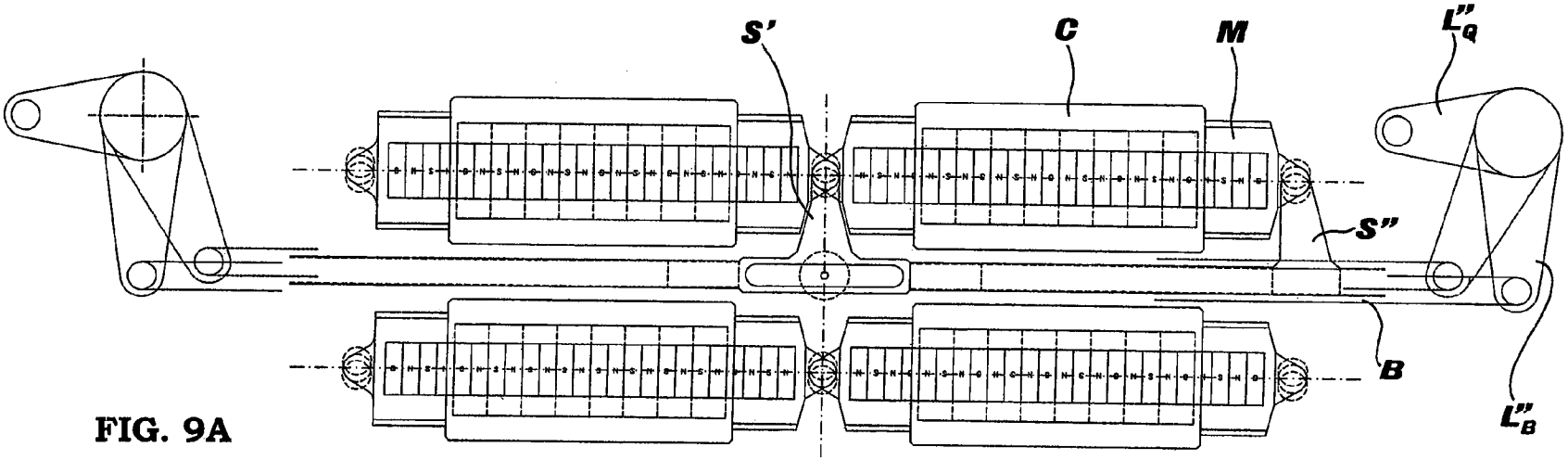
FIGS. 9A and 9B are diagrammatic elevation side and plan views of a further preferred embodiment of the invention.
Figure 9B:
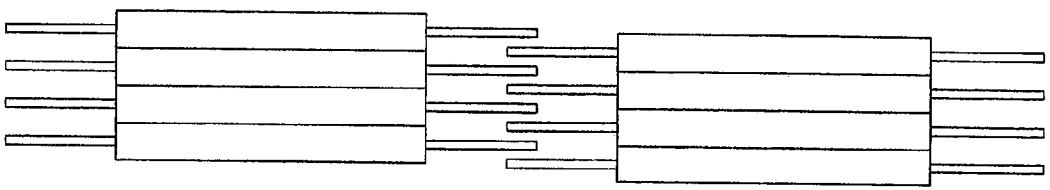

According to a further preferred embodiment, illustrated in FIGS. 9A and 9B, the overall length of the coil packs of each motor is smaller than the motor plate M, which hence protrudes by a certain length from both ends of the stator part C. The Applicant could observe that, although the larger mass of the permanent magnets causes increases of power losses in terms of inertia forces, the efficiency of the motor drive is improved compared to the embodiment illustrated previously and overall it provides a certain benefit.

In this case, both ends of the motor bodies M are restrained to support brackets S' and S" integral with the drive bar B. Since the brackets S' and S" shift integrally with bar B even with a vertical shift component, the coils making up the stator feature a sufficiently wide sliding housing for the magnet M to allow such vertical shifts. To prevent bars B from oscillating transversally (perpendicularly to the drawing sheet) in the horizontal plane, they are constrained by sliding guides (not shown) known per se in the field. To prevent bars B from oscillating and shaking on the sliding plane (i.e. vertically in the plane of the drawing sheet), it is further provided a guide rod (not shown) descending from above—suitably restrained to the loom structure—and pivoting in a substantially central position on bar B, between two adjacent motors.

Finally, the sizing of the L-shaped levers L' and L" is such so as to best exploit the power of the motor along a sufficiently long useful stroke: a particularly preferable value of the lever ratio $L_B/L_Q$ (lever integral with the bar/lever integral with the frame) is in the range 1.1-1.4, more preferably in the order of 1.3.

The arrangement of the invention, as can be inferred from the preceding description, perfectly achieves the objects set forth in the introduction.

In fact it allows to vary the motion law and the run/stroke of each individual frame at any time, by means of a simple electronic intervention on the control of the respective linear motor, thereby achieving an excellent degree of control flexibility. On the other hand, through the control unit it is possible to determine the relationship existing between the loom main motor and the motion of the various frames, also varying the relative phase between one another, thereby achieving extremely varied and rapidly changeable laws of the warp shed opening.

The warp shed can be made to vary without halting the machine and it is possible to quickly change from one item to the other: this also entails the opportunity to adjust the geometrical asset of the shed at will, changing the sequence thereof according to the most diverse requirements (for example, in an air-jet loom, to increase in a targeted manner the shed opening and obtain an easier weft insertion or a better separation of the warp yarns).

The side dimensions are still extremely small (remaining within the machine shoulders), since the motor drive and the corresponding kinematic mechanisms are housed below the frames; besides, further space is freed, compared to traditional weaving looms, because the room usually occupied by the current dobbies and by the corresponding outer drive is left free.

A reduced overall inertia and therefore a better mechanic efficiency is also advantageously achieved, due to the simplification of the mechanical transmissions.

Again, being able to arrange a single motor every four frames and over a significant portion of the corresponding drive bar B, there is sufficient space to configure efficient motors which do not experience significant overheating problems.

Finally, there being provided to keep an articulated quadrilateral kinematic structure driven by a single linear motor for each frame, there are absolutely no problems concerning coordination and synchronisation of multiple controls on the same frame.

It is however understood that the invention is not limited to the particular embodiments illustrated above, which represent only non-limiting examples of the scope of the invention, but that a number of changes are possible, all within the reach of a skilled person in the field, without departing from the scope of the invention.

The invention claimed is:

1. A control mechanism of a heald frame in weaving looms, of the type comprising a frame hinged to a linkage capable of converting the substantially rectilinear motion of a drive bar into a vertical motion of the frame, characterised in that said drive bar is provided with at least a permanent magnet body (M) and in that an electric coil structure (C) is further provided, in whose proximity said magnet body (M) is intended to slide, fixed with respect to the loom and forming the armature of a linear electric motor of which said magnet body (M) represents the mobile part, wherein said magnet body (M) consists of a series of permanent magnets (m) distributed mutually adjacent over a plate integral with said bar (B), and said plate, equipped with a series of permanent magnets (m), is hinged by at least one end to an anchoring bracket of said bar (B).

2. The control mechanism as claimed in claim 1, wherein the bar is located below the frames and said electric-coil structure (C) extends into a longitudinal direction of the bar (B) by a length which is a submultiple of the longitudinal span available between the loom shoulders.

3. The control mechanism as claimed in claim 1, wherein said electric-coil structure (C) has the shape of a drawer into which said magnet body (M) is intended to slide, said magnet body (M) featuring sliding means capable of supporting and slide-guiding the same within the drawer-shaped structure.

4. The control mechanism as claimed in claim 1, wherein said plate, equipped with a series of permanent magnets (m) is hinged at both ends through anchoring brackets to said bar (B) and crosses entirely said drawer-shaped electric-coil structure (C) into which it slides.

5. The control mechanism as claimed in claim 1, wherein said electric-coil structure (C) consists of a series of coil packs, each make up of a certain number of individually controllable basic coils.

6. The control mechanism as claimed in claim 5, wherein said number of basic coils is between three and four.

7. A drive arrangement for heald frames in a weaving loom comprising a plurality of control mechanisms lying side by side, each said control mechanism comprising a frame hinged to a linkage capable of converting the substantially rectilinear motion of a drive bar into a vertical motion of the frame, characterised in that said drive bar is provided with at least a permanent magnet body (M) and in that an electric coil structure (C) is further provided, in whose proximity said magnet body (M) is intended to slide, fixed with respect to the loom and forming the armature of a linear electric motor of which said magnet body (M) represents the mobile part, and characterised in that the electriccoil structures (C) have a length which is a submultiple of the length of said bars (B) and the electriccoil structures (C) are arranged offset in respect to each other in the displacement direction.

8. A drive arrangement for heald frames in a weaving loom, comprising a plurality of mechanisms lying side by side, each heald frame comprising a frame hinged to a linkage capable of converting the substantially rectilinear motion of a drive bar into a vertical motion of the frame, characterised in that said drive bar is provided with at least a permanent magnet body (M) and in that an electric coil structure (C) is further provided, in whose proximity said magnet body (M) is intended to slide, fixed with respect to the loom and forming the armature of a linear electric motor of which said magnet body (M) represents the mobile part, the electriccoil structures (C) having a length which is a submultiple of the length of said bars (B) and are arranged offset in respect to each other in the displacement direction, wherein over the available length are arranged without side overlapping up to four of said electriccoil structures (C) offset along the longitudinal axis of the bars and such longitudinally offset arrangement of said linear motors is repeated every four groups of bars.

9. The drive arrangement as claimed in claim 8, wherein said electric coils (C) and corresponding magnet bodies (M) are arranged in an offset position also above and below said bars (B).

10. A drive arrangement for heald frames in a weaving loom, comprising a plurality of mechanisms lying side by side as claimed in claim 2, characterised in that the electric-coil structures (C) have a length which is a submultiple of the length of said bars (B) and are arranged offset in respect to each other in the displacement direction.

11. A drive arrangement for heald frames in a weaving loom, comprising a plurality of mechanisms lying side by side as claimed in claim 1, characterised in that the electric-coil structures (C) have a length which is a submultiple of the length of said bars (B) and are arranged offset in respect to each other in the displacement direction.

12. A drive arrangement for heald frames in a weaving loom, comprising a plurality of mechanisms lying side by side as claimed in claim 1, wherein the bar is located below the frames and said electriccoil structure (C) extends into a longitudinal direction of the bar (B) by a length which is a submultiple of the longitudinal span available between the loom shoulders, and the electriccoil structures (C) have a length which is a submultiple of the length of said bars (B) and are arranged offset in respect to each other in the displacement direction.

13. A drive arrangement for heald frames in a weaving loom, comprising a plurality of mechanisms lying side by side as claimed in claim 1, wherein the electriccoil structures (C) have a length which is a submultiple of the length of said bars (B) and are arranged offset in respect to each other in the displacement direction.

14. The control mechanism as claimed in claim 1, wherein said electriccoil structure (C) consists of a series of coil packs, each make up of a certain number of individually controllable basic coils.

15. The control mechanism as claimed in claim 14, wherein said number of basic coils is between three and four.

* * * * *